US007296418B2

(12) United States Patent
Kirkconnell et al.

(10) Patent No.: US 7,296,418 B2
(45) Date of Patent: Nov. 20, 2007

(54) MULTI-STAGE CRYOCOOLER WITH CONCENTRIC SECOND STAGE

(75) Inventors: Carl S. Kirkconnell, Huntington Beach, CA (US); Ken J. Ciccarelli, Huntington Beach, CA (US); Abram Alaniz, Culver City, CA (US)

(73) Assignee: Raytheon Company, Waltham, MA (US)

( * ) Notice: Subject to any disclaimer, the term of this patent is extended or adjusted under 35 U.S.C. 154(b) by 389 days.

(21) Appl. No.: 11/038,822

(22) Filed: Jan. 19, 2005

(65) Prior Publication Data

US 2006/0156741 A1 Jul. 20, 2006

(51) Int. Cl.
*F25B 9/00* (2006.01)

(52) U.S. Cl. ..... 62/6

(58) Field of Classification Search ..... 62/6
See application file for complete search history.

(56) References Cited

U.S. PATENT DOCUMENTS 4,019,336 A * 4/1977 Mijnheer et al. ..... 62/6
4,277,948 A * 7/1981 Horn et al. ..... 62/6
5,295,355 A 3/1994 Zhou et al.
5,519,999 A * 5/1996 Harpole et al. ..... 62/6
5,680,768 A 10/1997 Rattray et al.
5,722,243 A 3/1998 Reeves et al.
6,076,358 A 6/2000 Bin-Nun et al.
6,167,707 B1 * 1/2001 Price et al. ..... 62/6
6,230,499 B1 5/2001 Hohne
6,330,800 B1 12/2001 Price et al.

FOREIGN PATENT DOCUMENTS

EP 0 614 059 A 9/1994
EP 0 717 245 A 6/1996

* cited by examiner

*Primary Examiner*—William C Doerrler
(74) *Attorney, Agent, or Firm*—Leonard A. Alkov

(57) ABSTRACT

A multi-stage cryocooler includes a concentric second-stage pulse tube expander in which a pulse tube is located within a second-stage regenerator. In one embodiment, an inner wall of the regenerator also functions as an outer wall of the pulse tube. In another embodiment, there is an annular gap between an inner wall of the regenerator and an outer wall of the pulse tube. The gap may be maintained at a low pressure, approaching a vacuum, by placing the gap in fluid communication with an environment around the cryocooler, such as the low-pressure environment of space. The integrated second-stage structure, with the pulse tube within the annular regenerator, provides several potential advantages over prior multi-stage cryocooler systems.

15 Claims, 4 Drawing Sheets

MULTI-STAGE CRYOCOOLER WITH CONCENTRIC SECOND STAGE

BACKGROUND OF THE INVENTION

1. Technical Field of the Invention

This invention is in the field of cryocoolers, and more particularly in the field of regenerative cryocoolers.

2. Background of the Related Art

Multi-stage cryocoolers are of fundamental interest for many applications in which cryogenic cooling is required. For example, some applications require the simultaneous cooling of two objects to cryogenic, but different, temperatures. In the case of a long wave infrared sensor, for instance, the focal plane assembly may require an operating temperature of around 40 K, while the optics may need to be maintained at a different temperature, such as about 100 K. One approach for such situations is to use a single-stage cooler and extract all of the refrigeration at the coldest temperature. However, this is thermodynamically inefficient. Another approach is to use two single-stage cryocoolers with one each at the two temperature reservoirs. This approach has the disadvantage of being expensive and large in size. A better approach that has been done in the past is to use a two-stage cryocooler with the first-stage cooling the higher operating temperature component, and the second stage cooling the lower operating temperature component. Multi-stage cryocoolers are generally more efficient than single-stage coolers, because a portion of the internal parasitic thermal losses can be removed from the system at higher temperatures, thus producing less entropy generation.

FIG. 1 shows a portion of a prior art cryocooler 10. The cryocooler 10 includes a compressor 11 that is coupled to a first-stage Stirling expander 20 with a first-stage regenerator 21, a plenum 22, and a piston or displacer 23. The piston 23, which contains the regenerator 21, oscillates within a cold cylinder 25. A wall of the cold cylinder 25 provides first stage pressure containment and thermal isolation from the ambient warm end. The plenum 22 and a motor assembly 27 are contained within an expander housing 26. The first-stage expander 20 also includes a first-stage heat exchanger 24 in a first-stage manifold 28. The piston or displacer 23 is used to expand the working gas, such as helium, downstream of the regenerator 21 such that refrigeration is produced in the first-stage heat exchanger 24. The working gas absorbs the first stage heat load from the environment as it passes through the first-stage heat exchanger 24. The first-stage heat exchanger 24 is in pneumatic communication with a second-stage pulse tube expander 30, where the (colder) second-stage refrigeration is produced. The pulse tube expander 30 includes a second-stage regenerator 31 and a pulse tube 32. The second-stage regenerator 31 and the pulse tube 32 may be generally parallel to one another, forming legs of a U-shaped configuration. The second-stage regenerator 31 and the pulse tube 32 are linked together by a flow passage 36 in a second-stage manifold 41. The flow passage 36 links a downstream end of the second-stage regenerator 31 with an upstream end of the pulse tube 32. End caps 42 and 43 close off the respective ends of the second-stage regenerator 31 and the pulse tube 32, within the second-stage manifold 41. A second-stage cold heat exchanger 44 is at an upstream end of the pulse tube 32, in the second-stage manifold 41. A second-stage warm heat exchanger 46 is at a downstream end of the pulse tube 32, in the first-stage manifold 28. The cryocooler 10 may be used to cool objects thermally coupled to either or both of the manifolds 28 and 41. Objects in thermal communication with the first-stage manifold 28 are cooled at a first cold temperature, and objects in communication with the second-stage manifold 41 are cooled at an even lower cold temperature. Further details regarding prior art cryocoolers may be found in commonly-assigned U.S. Pat. Nos. 6,167,707, and 6,330,800, the descriptions and figures of which are incorporated herein by reference.

In installation of the prior art cryocooler 10, the cold cylinder 25, the first-stage manifold 28, and the second-stage pulse tube expander 30 (collectively a cold head 50) are often required to be supported only at the expander housing 26. This leaves the second-stage pulse tube expander 30, the second-stage manifold 41, the first-stage manifold 28, and much of the cold cylinder 25, cantilevered off of the housing 26. This has caused difficulties, particularly in space flight applications, where the cooling system must be able to withstand loads and random vibrations generated during launch.

From the foregoing it will be appreciated that improvements in multi-stage cryocoolers may be possible.

SUMMARY OF THE INVENTION

According to an aspect of the invention, a multi-stage cryocooler includes: a first-stage expander; and a second-stage pulse tube expander downstream of the first-stage expander. The second-stage expander includes an annular second-stage regenerator.

According to another aspect of the invention, a multi-stage cryocooler includes: a first-stage Stirling expander; and a second-stage pulse tube expander downstream of the first-stage expander. The second-stage expander includes: a second-stage regenerator; and a pulse tube within and radially surrounded by the second-stage regenerator.

According to yet another aspect of the invention, a multi-stage cryocooler includes: a first-stage Stirling expander; and a second-stage pulse tube expander downstream of the first-stage expander. The first-stage expander includes a first-stage manifold. The second-stage expander includes: an annular second-stage regenerator; a pulse tube concentrically within the second-stage regenerator; and a second-stage manifold. The first-stage manifold is coupled to an upstream end of the second-stage regenerator, and to a downstream end of the pulse tube. The second-stage manifold is coupled to a downstream end of the second-stage regenerator, and to an upstream end of the pulse tube. The second-stage regenerator, the pulse tube, and the second-stage manifold are all substantially axisymmetric.

To the accomplishment of the foregoing and related ends, the invention comprises the features hereinafter fully described and particularly pointed out in the claims. The following description and the annexed drawings set forth in detail certain illustrative embodiments of the invention. These embodiments are indicative, however, of but a few of the various ways in which the principles of the invention may be employed. Other objects, advantages and novel features of the invention will become apparent from the following detailed description of the invention when considered in conjunction with the drawings.

BRIEF DESCRIPTION OF THE DRAWINGS

In the annexed drawings, which are not necessarily to scale.

DETAILED DESCRIPTION

A multi-stage cryocooler includes a concentric second-stage pulse tube expander in which a pulse tube is located within a second-stage regenerator. In one embodiment, an inner wall of the regenerator also functions as an outer wall of the pulse tube. In another embodiment, there is an annular gap between an inner wall of the regenerator and an outer wall of the pulse tube. The gap may be maintained at a low pressure, approaching a vacuum, by placing the gap in fluid communication with an environment around the cryocooler, such as the low-pressure environment of space. The integrated second-stage structure, with the pulse tube within the annular regenerator, provides several potential advantages over prior multi-stage cryocooler systems. First, the mass of the first- and second-stage manifolds may be reduced because of the placement of the pulse tube within the second-stage regenerator. The second-stage manifold is used for putting the regenerator and the pulse tube in communication with one another, and for allowing thermal coupling to heat loads. This may reduce mechanical loads on the cold cylinder, which may be mechanically supported only at one end (the end opposite the first-stage manifold). The axisymmetric configuration of the second-stage expander facilitates configuring the second-stage manifold axisymmetrically, allowing substantially isotropic load carrying characteristics, and potentially simplifying integration for an end user, who need not constrain orientation of thermal straps relative to the second-stage manifold. Further, the placement of the pulse tube within the second-stage regenerator may allow for more uniform flow from the second-stage regenerator through the second-stage manifold to the pulse tube. For instance, the pulse tube may be located axisymmetrically within the second-stage regenerator, and the manifold may be configured to allow substantially axisymmetric flow into an upstream end of the pulse tube. Finally, the integration of the second-stage regenerator and the pulse tube into a single contained unit may also increase the structural strength of the second-stage pulse tube expander.

Figure 1:
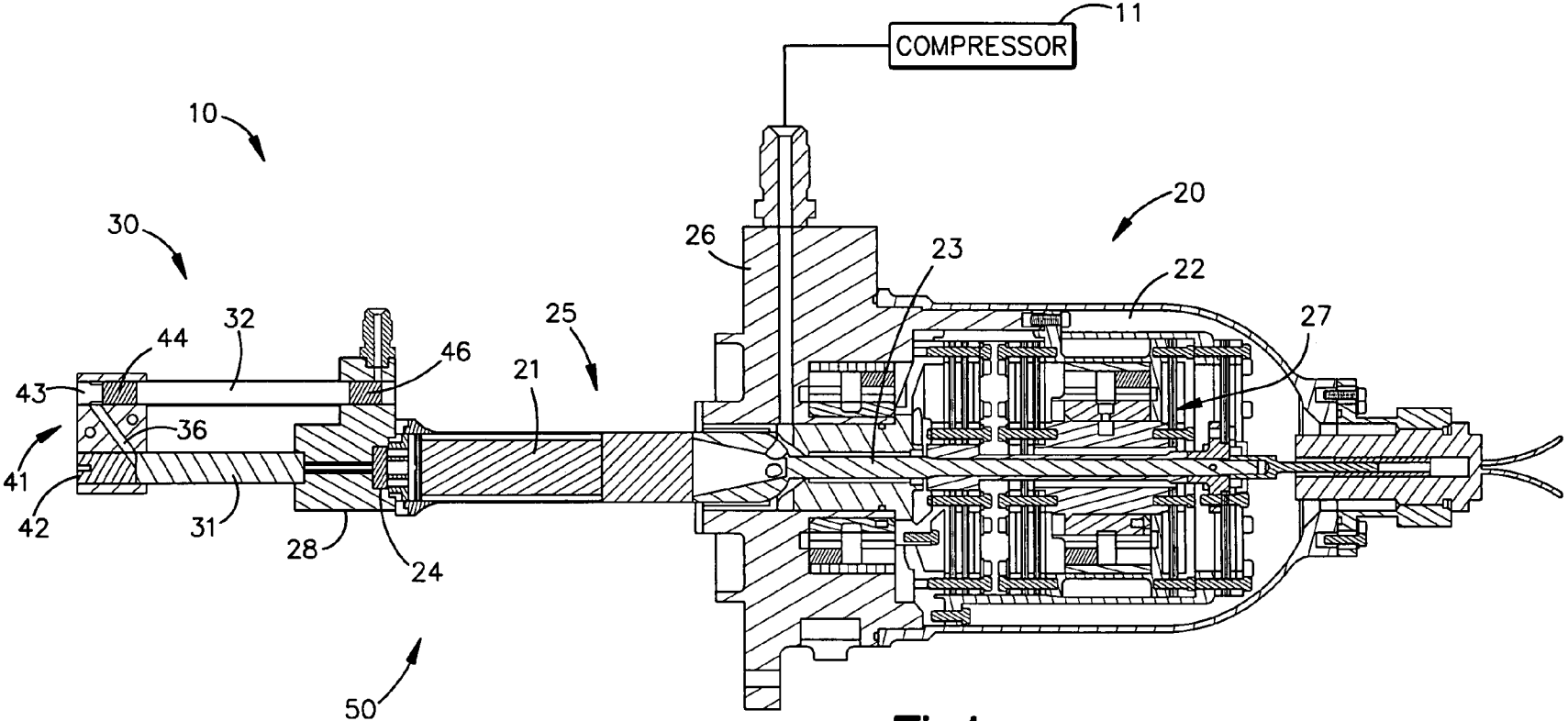
Fig.1 (PRIOR ART)
FIG. 1 is a cross-sectional view of a prior art multi-stage cryocooler.
Figure 2:
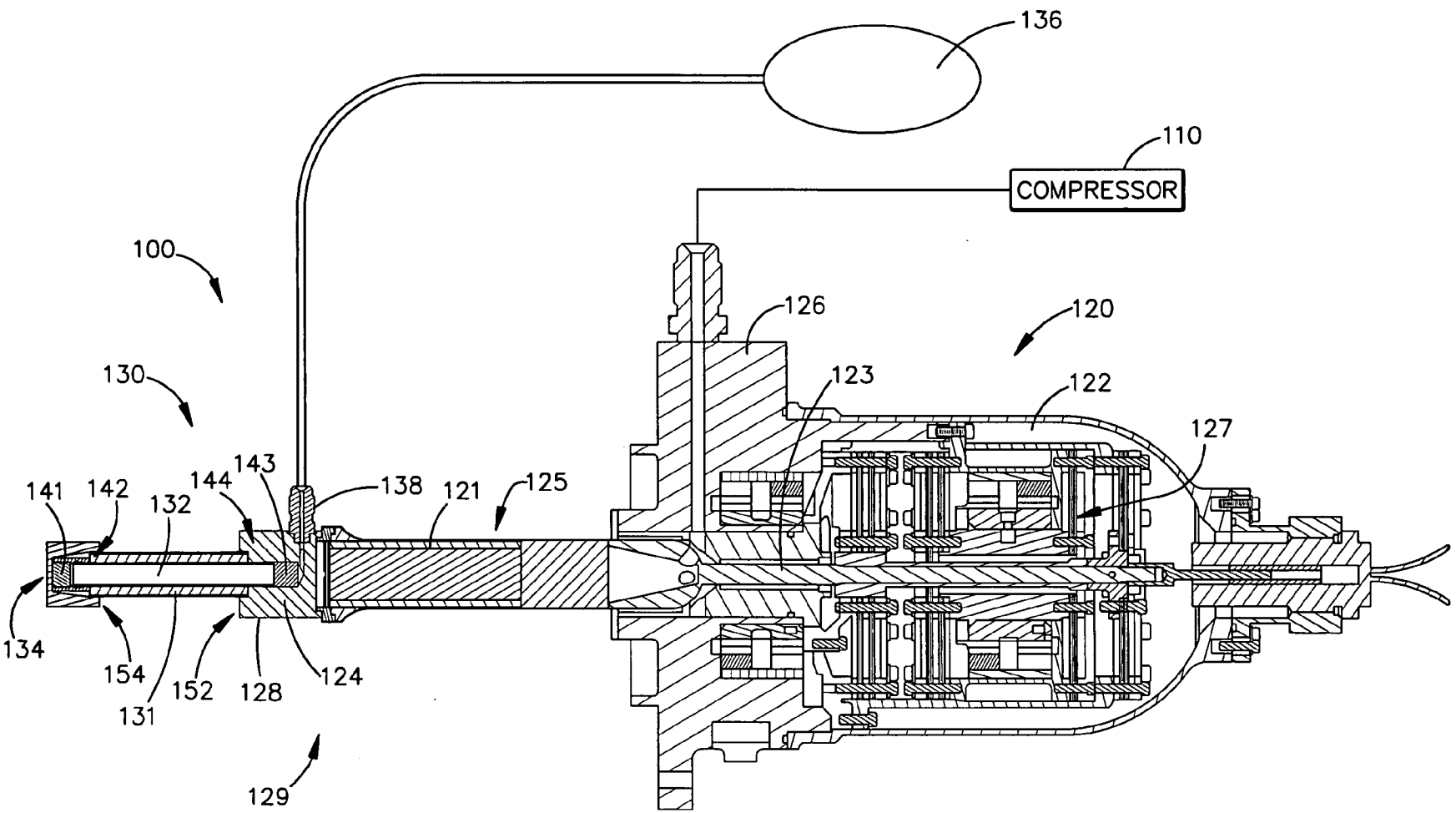
FIG. 2 is a cross-sectional side view of a multi-stage cryocooler in accordance with the present invention.

With reference initially to FIG. 2, details are now discussed of a multi-stage cryocooler 100. The cooler 100 includes a compressor 110 coupled to a first-stage expander 120, such as a Stirling expander. The expander 120 may be substantially identical to the expander 20 of the prior art cryocooler 10 (FIG. 1), and may include such parts as a first-stage regenerator 121, a plenum 122, and a piston or displacer 123, a cold cylinder 125, an expander housing 126, and a motor assembly 127. Working fluid exiting the first-stage regenerator 121 proceeds into a first-stage heat exchanger 124 that is in a first-stage manifold 128. The first-stage heat exchanger 124 includes through holes proceeding through the first-stage manifold 128, for allowing flow of the working fluid into a second-stage pulse tube expander 130. The first-stage manifold 128 may be maintained at a first-stage cold temperature, and may be linked to heat-producing items via suitable thermal straps (not shown) to cool or maintain temperature of the heat-producing items.

The cold cylinder 125 (and its contents) and the second-stage pulse-tube expander 130 are parts of a cold head 129. The cold head 129 is mechanically coupled to the expander housing 126.

The second-stage pulse tube expander 130 includes a second-stage regenerator 131, a pulse tube 132, and a second-stage manifold 134. The working gas proceeds from the first-stage manifold 128 into the second-stage regenerator 131. Within the second-stage manifold 134, the working gas is ported into the pulse tube 132. It flows through the pulse tube 132, and into the first-stage manifold 128. From the first-stage manifold 128, the outlet from the pulse tube 132 may be coupled to a surge volume 136, via an inertance port 138. The surge volume 136 may be maintained at an ambient warm temperature. Further details regarding configuration and use of an ambient-temperature surge volume may be found in commonly-assigned U.S. application Ser. No. 10/762,867, titled "Cryocooler With Ambient Temperature Surge Volume" filed Jan. 22, 2004, the description and figures of which are incorporated herein by reference.

The pulse tube 132 is located radially within the second-stage regenerator 131. The second-stage regenerator may be an annular regenerator, with the pulse tube 132 centered within the second-stage regenerator 131. The pulse tube 132 has a second-stage cold heat exchanger 141 located at an upstream end 142 of the pulse tube 132, within the second-stage manifold 134. The pulse tube 132 also has a second-stage warm heat exchanger 143 located at a downstream end 144 of the pulse tube 132, within the first-stage manifold 128. The second-stage cold heat exchanger transfers heat from the second-stage manifold 134, which may be made of a suitable material, such as copper. The second-stage warm heat exchanger 143 transfers heat to the first-stage manifold 128.

The second-stage expander 130 may be substantially axisymmetric, with the pulse tube 132 being axisymmetrically located within the second-stage regenerator 131. The first-stage manifold 128 and the second-stage manifold 134 may also be substantially axisymmetric. The structural load bearing capability of the both expander stages may thus be substantially independent of the radial orientation of any structural loading force. Thus there advantageously may be no need to take into account orientation of the second-stage expander 130 when thermally coupling the second-stage manifold 134 to devices to be cooled, by use of cryogenic thermal straps (not shown). By contrast, in the U-turn second-stage configuration, such as shown in the second-stage expander 30 (FIG. 1), a designer must take into account variations in structural strength for different orientations, when attaching loads to the second-stage manifold 41 (FIG. 1).

Perhaps more importantly, the axisymmetric cold head 129, with its axisymmetric second-stage expander 130, may advantageously increase the frequency of the lowest cantilever bending mode. An embodiment of the configuration described herein has been found to have a fundamental cantilever bending mode frequency above 200 Hz. This compares with prior designs having lowest cantilever bending modes between 115 and 160 Hz. Since deflection is reduced as the inverse square of the frequency, the higher natural frequency of the cold head 129 greatly reduces its sensitivity to vibrations.

Another advantage of the axisymmetric second-stage expander 130 is that flow may be substantially axisymmetric in both the second-stage regenerator 131 and the pulse tube 132. The flowing working gas may be introduced substantially axisymmetrically at an upstream end 152 of the second-stage regenerator 131, where the regenerator 131 interfaces with the first-stage manifold 128. In the second-stage manifold 134 flow of the working gas may be substantially axisymmetrically turned from a downstream end 154 of the second-stage regenerator 131, into the upstream end 142 of the pulse tube 132. The substantial axisymmetry in flow within the second-stage regenerator 131 and the pulse tube 132 may result in more uniform performance, and thus improved performance, relative to prior cryocoolers with non-uniform flow. This increased uniformity in performance may be due to decreased mixing at the pulse tube cold end.

Figure 3:
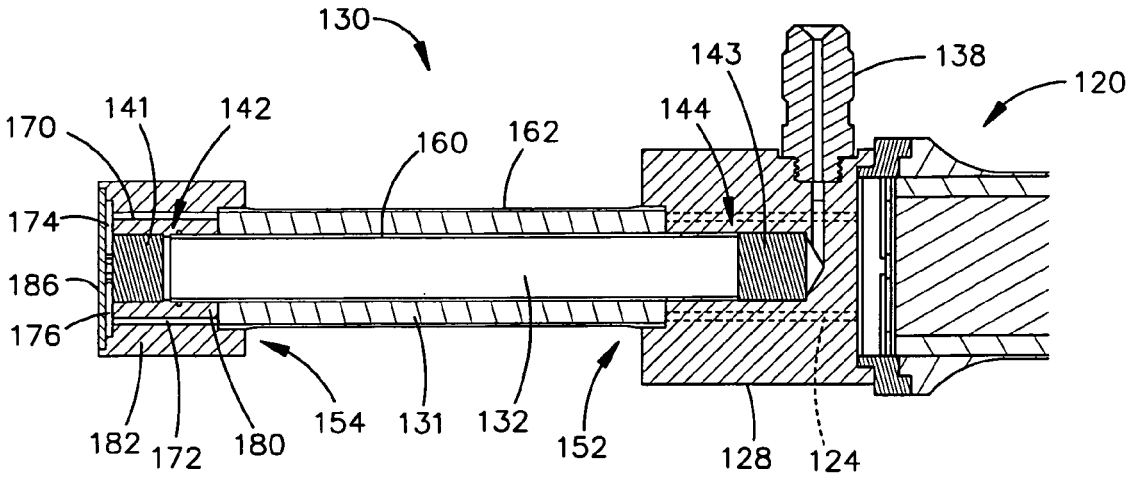
FIG. 3 is a cross-sectional view of one embodiment of the second stage of the cryocooler of FIG. 2.

Turning now to FIG. 3, certain details are shown of one embodiment of the second-stage expander 130. The embodiment shown in FIG. 3 is a two-tube embodiment, with an interior wall 160 serving as both the outer wall of the pulse tube 132, and as the inner wall of the second-stage regenerator 131. A second tube or wall 162 serves as the outer wall of the second-stage regenerator 131.

The second-stage manifold 134 has longitudinal flow passages 170 and 172, and radial flow passages 174 and 176. The longitudinal flow passages 170 and 172 may be parts of an annular gap between an inner portion 180 and an outer portion 182 of the second-stage manifold 134. The radial flow passages 174 and 176 may be portions of a disk-shaped flow cavity beneath an end cap 186 of the first-stage manifold 134. Flow may proceed from the downstream end 154 of the second-stage regenerator 131, through the longitudinal flow passages 170 and 172 through the radial flow passages 174 and 176, and into the second-stage cold heat exchanger 141 at the upstream end 142 of the pulse tube 132. This turning of the flow from the downstream end 154 of the second-stage regenerator 131, to the upstream end 142 of the pulse tube 132, may be substantially axisymmetric. Alternatively, flow passages within the second-stage manifold 134 may allow for some asymmetry in turning of the flow from the second-stage regenerator 131 to the pulse tube 132.

Figure 4:
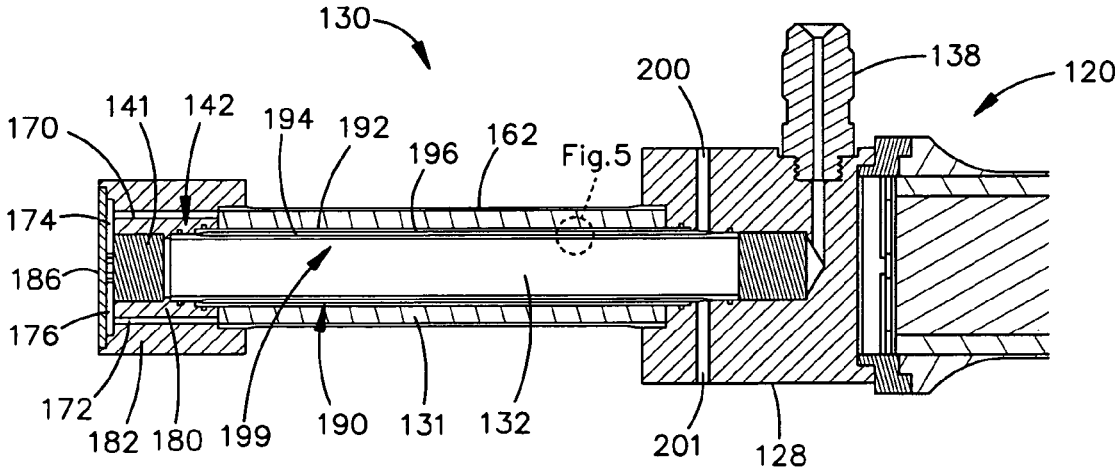
FIG. 4 is a cross-sectional view of another embodiment second stage of the cryocooler of FIG. 2.

FIG. 4 shows an alternate embodiment of the second-stage expander 130, a three-tube embodiment that includes an insulator 190 between an inner wall 192 of the regenerator 131, and an outer wall 194 of the pulse tube 132. The insulator 190 may be a gap 196 between the walls 192 and 194. The gap 196 may be a vacuum gap, for instance, having a pressure within the gap 196 of about $1\times10^{-5}$ torr or less. As shown, the gap 196 may be a recess formed by a thinned portion 199 of the pulse tube wall 194. Alternatively, the gap 196 may be formed by other suitable methods.

The gap 196 may be in communication with an ambient environment around the cryocooler 100. The first-stage manifold 128 may have ports 200 and 201 to allow the gap 196 to be in fluid communication with the environment surrounding the cryocooler 100. Since cryocoolers are typically utilized in vacuum environments, such as the vacuum of space, placing the gap 196 in communication with the environment surrounding the cryocooler 100, and allowing the gap 196 to be at a low-pressure vacuum.

The gap 196 may have a width or thickness on the order of 10 mils. The gap 196 may have any suitable width such that sufficient vacuum conductance exists to pull a hard vacuum in the entire gap 196, via the ports 200 and 201. The gap 196 may be an annular gap, or may have other suitable shapes.

Figure 5:
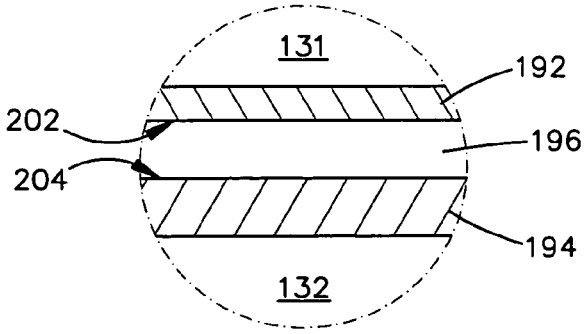
FIG. 5 is a detailed view of a portion 5-5 of the second stage of FIG. 4.

With reference now in addition to FIG. 5, the regenerator inner wall 192 and the pulse tube wall 194 may have respective low-radiative-emissivity surfaces 202 and 204, facing the gap 196. The low-radiative-emissivity surfaces may be configured to minimize radiative heat transfer across the gap 196. The low-radiative-emissivity surfaces 202 and 204 may be gold-plated surfaces, or may be polished-metal surfaces, such as surfaces of polished stainless steel.

It may be advantageous to have the vacuum gap 196 between the pulse tube 132 and the second-stage regenerator 131 to prevent undesired heat transfer between the pulse tube 132 and the second-stage regenerator 131, which otherwise may degrade performance of the second-stage expander 130. The temperature gradients along the second-stage regenerator 131 and the pulse tube 132 are different from one another—the temperature gradient along the second-stage regenerator 131 is nearly linear, while the temperature gradient along the pulse tube 132 is non-linear. Without insulation between the second-stage regenerator 131 and the pulse tube 132, a radial heat flow would occur between the two devices, possibly degrading device performance. Putting a vacuum gap between the devices minimizes the radial heat transfer, and thus may improve performance.

Nevertheless, the radial heat transfer described in the previous paragraphs may be acceptable in some situations, and the two-tube configuration of FIG. 3 may be suitable for those situations. For example, for a 1-Watt, 77-Kelvin cryocooler the two-tube configuration may be suitable, with some level of radial heat transfer between the second-stage regenerator 131 and the pulse tube 132 being tolerated. But for a cryocooler operating at a lower temperature, for example 10 Kelvin, the radial heat transfer may significantly affect operation, and the three-tube configuration of FIGS. 4 and 5 may be preferable.

Figure 6:
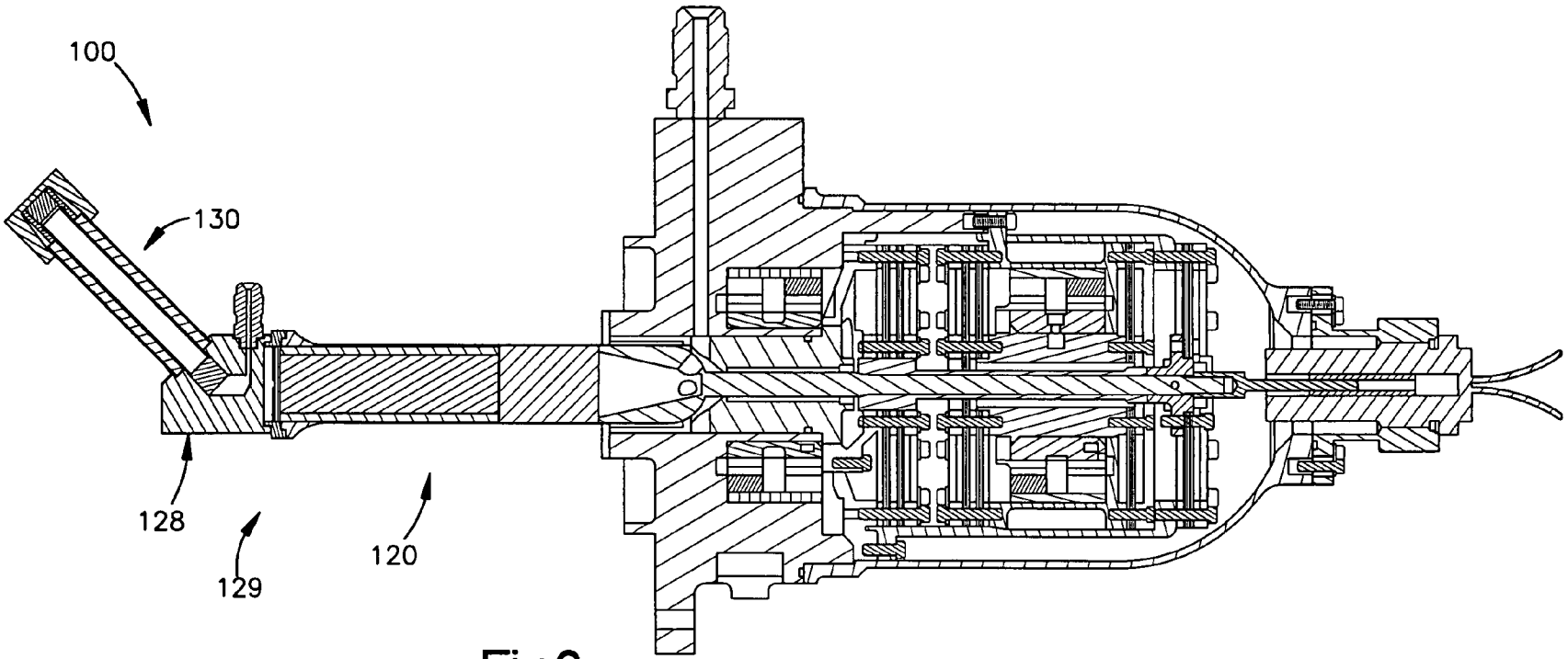
FIG. 6 is a cross-sectional view of an alternate embodiment cryocooler in accordance with the present invention, having an angled second stage.

With reference to FIG. 6, the second-stage expander 130 may be angled with regard to the first-stage expander 120. The term "angled" as used herein, refers to a non-zero angle between the second-stage expander 130 and the first-stage expander 120, such that the second-stage expander 130 is not in line with the first-stage expander 120. As shown in FIG. 6, the second-stage expander 130 may be at a 45° angle relative to the first-stage expander 120. More broadly, it may be advantageous to orient the second-stage expander 130 at any of a wide variety of angles relative to the first-stage expander 120, such as angles of 45°, 90°, or any other suitable angles.

The various embodiments of the cryocooler 100 described here allow for improved structural characteristics of the cold head 129. In addition, heat transfer performance of the second-stage expander 130 may be improved by providing more uniform, substantially axisymmetric, flow. It will be appreciated that the improved structural and heat transfer performance may allow for cryocoolers with decreased cost and weight as well.

Although the invention has been shown and described with respect to a certain preferred embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. A multi-stage cryocooler comprising:

a first-stage expander; and a second-stage pulse tube expander downstream of the first-stage expander;

wherein the second-stage expander includes (i) an annular second-stage regenerator with an inner wall and (ii) a pulse tube, with an outer wall, substantially centered radially within the second-stage regenerator, wherein the second-stage regenerator inner wall and the pulse tube outer wall are separated by a gap.

2. The cryocooler of claim 1, wherein the gap is a substantially annular gap.

3. The cryocooler of claim 1, wherein the gap is in fluid communication with an environment around the cryocooler.

4. The cryocooler of claim 1, wherein respective surfaces of the second-stage regenerator inner wall and the pulse tube outer wall that face the gap are low-radiative-emissivity surfaces.

5. The cryocooler of claim 4, wherein the low-radiative-emissivity surfaces are gold plated surfaces.

6. The cryocooler of claim 4, wherein the low-radiative-emissivity surfaces are polished metal surfaces.

7. The cryocooler of claim 1, wherein the gap is a vacuum gap maintained at a pressure of $1\times10^{-5}$ torr or less.

8. The cryocooler of claim 1, wherein the gap has a thickness on the order of 10 mils.

9. The cryocooler of claim 1, wherein the second-stage expander further includes a second-stage manifold mechanically coupled to a downstream end of the second-stage regenerator, and mechanically coupled to an upstream end of the pulse tube; and wherein the second-stage regenerator, the pulse tube, and the second-stage manifold are all substantially axisymmetric.

10. The cryocooler of claim 1, wherein the second-stage pulse-tube expander is angled relative to the first-stage expander.

11. A multi-stage cryocooler comprising:

a first-stage Stirling expander; and a second-stage pulse tube expander downstream of the first-stage expander;

wherein the second-stage expander includes:

a second-stage regenerator;

a pulse tube within and radially surrounded by the second-stage regenerator; and a pap between the second-stage regenerator and the pulse tube.

12. The cryocooler of claim 11, wherein the gap is a vacuum gap maintained at a pressure of $1\times10^{-5}$ torr or less.

13. The cryocooler of claim 11, wherein low-radiative-emissivity surfaces of the regenerator and the pulse tube adjoin the gap.

14. The cryocooler of claim 13, wherein the low-radiative-emissivity surfaces are gold plated surfaces.

15. The cryocooler of claim 13, wherein the low-radiative-emissivity surfaces are polished metal surfaces.

* * * * *